US007966790B2

(12) United States Patent
Michels et al.

(10) Patent No.: US 7,966,790 B2
(45) Date of Patent: Jun. 28, 2011

(54) APPARATUS FOR PULLING FOIL HOOD DOWN OVER LARGE OBJECT

(75) Inventors: Frank-Rolf Michels, Kleve (DE); Norbert Vermeulen, Kleve (DE)

(73) Assignee: MSK-Verpackungs-Systeme GmbH, Kleve (DE)

( * ) Notice: Subject to any disclaimer, the term of this patent is extended or adjusted under 35 U.S.C. 154(b) by 137 days.

(21) Appl. No.: 12/272,027

(22) Filed: Nov. 17, 2008

(65) Prior Publication Data

US 2010/0071317 A1 Mar. 25, 2010

(30) Foreign Application Priority Data

Nov. 16, 2007 (EP) ..... 07022267

(51) Int. Cl.
*B65B 53/00* (2006.01)

(52) U.S. Cl. ..... 53/556; 53/441

(58) Field of Classification Search ..... 53/441, 53/459, 567, 577, 576, 397, 449
See application file for complete search history.

(56) References Cited

U.S. PATENT DOCUMENTS 4,050,219 A * 9/1977 Higgins ..... 53/567
4,064,678 A * 12/1977 Grocke ..... 53/567
4,473,990 A * 10/1984 Thimon ..... 53/567
4,724,658 A * 2/1988 Birkenfeld et al. ..... 53/557
6,032,439 A * 3/2000 Birkenfeld et al. ..... 53/441
6,470,654 B1 * 10/2002 Lachenmeier et al. ..... 53/567
6,865,865 B2 * 3/2005 Hannen et al. ..... 53/567
7,234,289 B2 * 6/2007 Hannen et al. ..... 53/441
2004/0107677 A1 6/2004 Hannen ..... 53/459

FOREIGN PATENT DOCUMENTS

EP 1266829 12/2002
WO WO 03062062 7/2003

* cited by examiner

*Primary Examiner* — Paul R Durand

(74) *Attorney, Agent, or Firm* — Andrew Wilford

(57) ABSTRACT

An apparatus for pulling a tubular film down over a large object has at least two guide and roller assemblies each flanking the object and each movable vertically along the object. Each assembly has a guide, an outer roller and an inner roller. The film is gathered by positioning the assemblies in an upper position, orienting the inner rollers generally below the outer rollers, and rotating the rollers while gripping the hood between them to pull the tube down and form it into folds beneath the roller assemblies. The film is pulled down over the object by orienting the inner rollers generally above the outer rollers, and then shifting the roller assemblies downward while rotating the rollers so as to pull the tube up and unfold it.

9 Claims, 5 Drawing Sheets

APPARATUS FOR PULLING FOIL HOOD DOWN OVER LARGE OBJECT

FIELD OF THE INVENTION

The present invention relates to an apparatus for packaging a large object. More particularly this invention concerns an apparatus for pulling a plastic-foil hood or tube down over such a large object.

BACKGROUND OF THE INVENTION

An apparatus is known from U.S. Pat. No. 6,865,865 for pulling a tubular film or a film hood down over a large object or stack of goods. Stack of goods means here in particular a plurality of packages, packets, bags or such units that are stacked to form a parallelepiped, typically standing on a pallet. This stack of goods is hooded with a tubular film or with a film hood, in order to give the stack of goods a greater stability on the one hand, and on the other hand in order to protect the stack of goods from atmospheric influences. The stack of goods can also be a few stacked units or else also one individual larger unit, for example from the white goods field (washing machines, refrigerators, dishwashers and suchlike). The stack of goods does not necessarily have to be parallelepipedal, but rather may also have different shapes. The tubular film or film hood that is used adapts itself, as it were, to the shape of the stack of goods.

Generally the tubular film is fed to these apparatuses from a tubular film supply. The tubular film is opened over the stack of goods and is gathered vertically.

As described in above-cited U.S. Pat. No. 6,865,865 the gathering arrangement has gathering rollers with each of which a single counter-roller is associated whose rotation axis is below the rotation axis of the gathering roller. For gathering, the tubular film is guided through between the gathering rollers and the respective counter-rollers. This system can subsequently also be used for transversely stretching the tubular film and also as a covering apparatus for covering the tubular film over the stack of goods. In the covering process, the tubular film is ungathered, the ungathered tubular film is again guided through between the gathering rollers and counter-rollers. The problem with this known apparatus is that at the end of the covering process or during the ungathering of the tubular film end, the tubular film sometimes jumps off in an uncontrolled manner from the gathering fingers or gathering corners and consequently can not be placed very precisely in the desired position on the stack of goods or on the pallet. In this respect, the known apparatus is capable of improvement.

OBJECTS OF THE INVENTION

It is therefore an object of the present invention to provide an improved method and apparatus for pulling a foil hood down over large object.

Another object is the provision of such an improved system for pulling foil hood down over large object that overcomes the above-given disadvantages, in particular that ensures a precise and controlled placement of the tubular film end on the stack of goods or on the pallet.

SUMMARY OF THE INVENTION

An apparatus for pulling a tubular film down over a large object has at least two guide and roller assemblies each flanking the object and each movable vertically along the object.

Each assembly has a guide, an outer roller and an inner roller. The film is gathered by positioning the assemblies in an upper position, orienting the inner rollers generally below the outer rollers, and rotating the rollers while gripping the hood between them to pull the tube down and form it into folds beneath the roller assemblies. The film is pulled down over the object by orienting the inner rollers generally above the outer rollers, and then shifting the roller assemblies downward while rotating the rollers so as to pull the tube up and unfold it.

In other words, the invention teaches an apparatus for covering a tubular film or a film hood over a stack of goods, wherein for gathering the tubular film at least two roller arrangements are provided with respectively at least one gathering roller and at least one counter-roller, and wherein the gathering rollers and the counter-roller are arranged during gathering in a gathering position in which the tubular film is in contact on the outer side with the gathering rollers and on the inner side with the counter-rollers. Only one counter-roller of each roller arrangement is in contact with the tubular film during gathering and, here, is oriented beneath a horizontal roller arrangement reference plane. A covering apparatus is provided, by which the tubular film is drawn over the stack of goods after gathering, the roller arrangements being entrained in the covering direction. This covering apparatus has at least two guide elements via which the tubular film, which is ungathered during the covering, is guided before its placement on the stack of goods. A counter-roller of each roller arrangement is in contact with the inner side of the tubular film at least during the ungathering of the tubular film end, and is arranged here in an ungathering position above the roller arrangement reference plane. By "generally above" and "generally below" is meant that the counter rollers are in positions mostly above or below a horizontal plane through the rotation axis of the respective gathering roller. Since the counter rollers might be substantially smaller than the respective gathering rollers, they might not project at all above or below the respective gathering roller in their upper and lower end positions.

It is within the framework of the invention that the (imaginary) horizontal roller arrangement reference plane runs through the rotation axis of a gathering roller of a roller arrangement in the gathering position. Furthermore, according to the invention the (imaginary) horizontal roller arrangement reference plane is transverse or perpendicular to the feeding direction of the tubular film or transverse/perpendicular to the covering direction of the tubular film. The (imaginary) roller arrangement reference plane is, at it were, fixedly arranged relative to a roller arrangement or a roller arrangement apparatus and is entrained or also moved with the roller arrangement or with the roller arrangement apparatus in the is covering direction.

According to a much preferred embodiment of the invention, the counter-roller of each roller arrangement that is in contact with the tubular film during gathering is arranged at least during ungathering of the tubular film end in an ungathering position moved contrary to the covering direction. Preferably, the counter-roller of each roller arrangement that is in contact with the tubular film during gathering is moved out of its gathering position vertically into its ungathering position.

In accordance with the invention the stack of goods is arranged on a pallet and forms therewith the object being wrapped. The tubular film end is ungathered at the end of the covering process and is placed over the stack of goods or onto the pallet. The tubular film or the film hood consists of an elastic plastic film. In so far as a film hood is concerned here and hereinbelow, this means the tubular film that is already separated off and welded off at one end.

It is within the framework of the invention that the tubular film is fed to the apparatus according to the invention from a tubular film supply. Preferably, the lateral edges of the tubular film are folded inward in the storage state. This is then termed a laterally folded tube. It is additionally within the framework of the invention that the tubular film that is fed to the apparatus is opened over or before the stack of goods. It is recommended that subsequently gatherers move into the tubular film end of the opened tubular film, so that the inner side of the tubular film end lies against the gatherers. Each gatherer preferably has a gathering bracket that extends transversely to the feeding direction of the tubular film or transversely to the vertical direction. After the introduction of the gatherers, the inner side of the tubular film end lies against the gathering brackets. According to a particularly preferred embodiment of the invention, the gatherers are arranged with their gathering brackets at the four corners of an opened tubular film that is rectangular in cross-section. In this case, the gathering brackets are also designated as gathering corners. It is also within the framework of the invention that the gatherers or gathering brackets are movable transversely to the feeding direction of the tubular film, in particular in the horizontal direction and namely preferably independently of each other. It is further within the framework of the invention that the gatherers or gathering brackets are movable in the feeding direction of the tubular film, in particular vertically.

According to recommendation, a counter-roller is associated with each gatherer or with each gathering bracket, which counter-roller is arranged in the feeding direction of the tubular film behind or under the associated gathering bracket, in particular vertically beneath the gathering bracket. It is recommended that a gathering roller is associated with each gatherer or gathering bracket, which gathering roller at least in the gathering position is arranged in the feeding direction of the tubular film behind or under the associated gathering bracket, in particular vertically beneath the gathering bracket. Preferably, after the introduction of the gatherers into the opened tubular film end, the gathering rollers are moved up or folded on, so that each gathering roller and the counter-roller associated with it pinch the tubular film between them. The gathering rollers and counter-rollers are then in their gathering position. The gathering rollers are preferably driven and, to this end, a drive motor is preferably associated with each gathering roller. According to recommendation, the counter-rollers are not driven. They function, as it were, as pressure rollers with respect to the associated gathering rollers.

A quite particularly preferred embodiment of the invention is characterized in that each roller arrangement consists of a gathering roller and only one counter-roller associated with the gathering roller. According to recommendation, four such roller arrangements are arranged at the four corners of a spread-out tubular film that is rectangular in cross-section.

According to a particularly preferred embodiment, the roller arrangements are oriented in the gathering position so that the rotation axis of the counter-roller is arranged in the feeding direction of the tubular film behind or vertically beneath the rotation axis of the gathering roller. In this embodiment the rotation axes of gathering roller and counter-roller are arranged so that a tangent in the respective contact point of the gathering roller and the associated counter-roller points obliquely downward and, with respect to the stack of goods, outward.

It is within the framework of the invention that in the gathering position, a tubular film section that is provided for formation of the film hood is drawn off the tubular film supply and is gathered before or over the stack of goods. It is further within the framework of the invention that at least two gatherers or gathering brackets are present, via which the tubular film is guided in the gathering position, wherein in the feeding direction of the tubular film behind a gatherer or gathering bracket a roller arrangement is provided through which the tubular film is guided in the gathering position and is gathered in the feeding direction behind the roller arrangement. It was already set forth above that preferably at least four gatherers/gathering brackets are provided, with each of which a respective roller arrangement is associated, and that very preferably are arranged at the four corners of a spread-out tubular film that is rectangular in cross-section. During gathering, the tubular film is gathered on the gatherers in a known manner in the manner of a bellows or concertina. On the basis of the preferred arrangement, described above, of the rotation axes of the rollers, during gathering a very uniform fold formation can be achieved the folds of which point obliquely downward and (with respect to the stack of goods) outward. With this uniform alignment of the folds, during the subsequent is covering over the stack of goods the film hood can be drawn off fold by fold in a simple and functionally reliable manner. Thus the film hood, during covering, is not exposed to any disadvantageous stain and in particular remains free of damage.

It is within the framework of the invention that the apparatus according to the invention has a separating apparatus and a welding apparatus by means of which the tubular film after gathering is separated off and welded off at the upper end of the film hood that is to be formed, forming the film hood. A particularly preferred embodiment of the invention is characterized in that the gatherers are also used as transverse stretch elements by means of which the tubular film or the tubular hood after gathering and preferably before covering over the stack of goods is stretched transversely. Preferably, to do this the gatherers with their gathering brackets (gathering corners) move apart transversely to the feeding direction of the tubular film. The transverse stretching is carried out with the proviso that the cross-section or horizontal cross-section of the transversely stretched tubular film is greater than the cross-section or horizontal cross-section of the stack of goods.

After the gathering and preferably after the transverse stretching, the tubular film is then drawn over the stack of goods by the covering apparatus. According to a particularly preferred embodiment of the invention, the gatherers are also the guide elements of the covering apparatus. In this preferred embodiment, the gathering brackets (gathering corners) therefore also function as guide brackets over which the tubular film, which is gathered during covering, is guided before its placement onto the sides of the stack of goods. According to a much preferred embodiment of the invention, the gatherers or guide elements are used for gathering and for transverse-stretching and for covering the tubular film. In all three processes, preferably at least four gatherers are involved that are preferably arranged at the four corners of the tubular film that is rectangular in cross-section. For covering with the film hood, the gatherers (guide elements) are movable in the covering direction of the film hood or vertically. To this end, the gatherers (guide elements) are preferably connected to a support frame that is movable in a corresponding manner, and that also carries the roller assemblies.

Before the covering or ungathering of the tubular film, the gathering rollers can be removed or swung outward of their gathering position engaging the respective counter-rollers. The ungathering then takes place only by drawing off the tubular film during the moving down of the gatherers or of the support frame. During this covering process, the gathering rollers may, however, also be folded onto and engage the counter-rollers. The ungathering is then additionally assisted by powered revers rotation of the gathering rollers. According to recommendation, the tubular film that is ungathered during the covering is guided via the gathering brackets of the gatherers. At the end of the covering process and during the ungathering of the tubular film end, the movement or vertical movement of the gatherers or of the support frame is preferably slowed down. It is within the framework of the invention that the counter-rollers of the roller arrangement are moved into the ungathering position at least at the end of the covering process or at least during the ungathering of the tubular film end respectively in the direction of the associated guide bracket or up to the associated guide bracket. It is to be understood that the ungathering of the tubular film end takes place in the lower region of the stack of goods, in particular on the pallet side. Preferably, all the counter-rollers of the roller arrangements move into the above-mentioned ungathering position. It is within the framework of the invention that in the ungathering position the counter-rollers have a smaller or a substantially smaller distance from the associated guide bracket than in the gathering position. The counter-rollers are therefore moved out of their gathering position into the ungathering position toward the guide bracket. Basically, it is also within the framework of the invention that the gathering rollers are movable vertically.

Preferably at least at the end of the covering process or at least during the ungathering of the tubular film end, the gathering rollers are folded on or moved up to the associated counter-rollers, so that the tubular film wall of the ungathered tubular film end is pinched between counter-rollers and gathering rollers. According to a first embodiment of the invention, the arrangement of the gathering rollers relative to the associated gatherers is unchanged in the gathering position and in the ungathering position. According to a second embodiment, the gathering rollers, like the counter-rollers, can be moved contrary to the covering direction of the tubular film into the ungathering position. In this embodiment, in the ungathering position a gathering roller then preferably has a smaller distance from the associated guide bracket than in the gathering position.

Due to the arrangement according to the invention of gathering rollers, counter-rollers and guide brackets, the tubular film end is held or transported from virtually up to the end to the end of the covering process between counter-roller and gathering roller and can therefore be guided in a very controlled manner over the respective guide brackets. The arrangement according to the invention guarantees a controlled, functionally reliable and precise ungathering of the tube film end and a placement of the tube film end in the correct position on the stack of goods or on the pallet.

It is recommended that at the end of the covering process and with counter-rollers arranged in the ungathering position, the gatherers are movable transversely to the covering direction inward in the direction of the stack of goods or in particular in the direction of a pallet forming the lower part of the object being wrapped. The tubular film end is then detached from the guide elements and is pressed up against the stack of goods or in particular the pallet. This placement normally takes place without costly additional measures, because owing to elastic restoring forces the transversely stretched tubular film places itself virtually automatically onto the stack of goods or onto the pallet. What is more, it is possible to use a heat-shrinkable film that is subsequently heat-shrunk into tight engagement with the object.

It is within the framework of the invention that the stack of goods is arranged on a pallet that has an upper panel forming surface and a lower panel forming a lower surface and according to one embodiment has in addition at least one pallet intermediate structure arranged between the pallet upper panel and the pallet lower panel. According to a first preferred embodiment, the gatherers are moved inward beneath the pallet and the tubular film end is then placed on the underside of the pallet lower surface. According to a second preferred embodiment of the invention, the guide elements move inward in the region beneath the pallet upper panel and above the pallet lower panel and in this embodiment the tubular film end is placed on the underside of the pallet upper panel or on the underside of the pallet intermediate panel arranged between pallet upper panel and pallet lower panel. Due to the arrangement according to the invention of gathering rollers, counter-rollers and gathering brackets, in both embodiments a very controlled and therefore precise placement of the tubular film end can be achieved.

According to a further embodiment of the invention, each roller arrangement has at least two counter-rollers, wherein only the first counter-roller of each roller arrangement is in contact with the tubular film during gathering and the second counter-roller of each roller arrangement is out of contact with the tubular film during gathering, and wherein both counter-rollers of each roller arrangement are in contact with the inner side of the tubular film during ungathering. Preferably, in this embodiment, the first counter-roller is arranged during gathering and during ungathering beneath the horizontal roller arrangement reference plane. Preferably, the second counter-roller is arranged above the horizontal roller arrangement reference plane during ungathering. Preferably, the second counter-rollers are able to be horizontally shifted, so that during gathering they are out of contact with the tubular film and are subsequently able to be moved out, so that during ungathering they are in contact with the tubular film.

In addition, an object of the invention is also a method for covering a tubular film or a foil hood over a stack of goods. Within the framework of this method, the gatherers or the support frame with connected gatherers are initially moved downward toward the pallet during the covering process. At the lower end of the stack of goods or in the region of the pallet, the vertical movement of the gatherers is preferably slowed down. Then the transfer of the counter-rollers into the ungathering position preferably takes place. According to recommendation, the gathering rollers are then moved up or folded on to the associated counter-rollers. Thereafter, the gatherers are moved inward, so that the tubular film end can be placed in particular on the pallet.

The invention is based on the knowledge that with the apparatus according to the invention, not only is a functionally very reliable gathering, transverse stretching and ungathering of the tubular film possible, but in addition also a very controlled and precise placement of the tubular film end onto the pallet beneath the stack of goods. Although the apparatus according to the invention is distinguished by a surprisingly high degree of functional reliability, this is nevertheless achieved by measures that are relatively simple and of little complexity. The invention further guarantees a reduced understretch region, through the systematic placement of the film onto the pallet underside, which leads to savings in the consumption of film. The apparatus according to the invention operates free of interruption and is also distinguished in particular by very low maintenance costs. The apparatus according to the invention therefore has considerable advantages compared with apparatuses known from the prior art.

BRIEF DESCRIPTION OF THE DRAWING

The above and other objects, features, and advantages will become more readily apparent from the following description, reference being made to the accompanying drawing in which:

As seen in FIGS. 1 and 2, an apparatus pulls a tubular film 1 down over an object 2, here a stack of goods. Here the term tubular film 1 is used throughout, although according to a preferred embodiment the tubular film 1 is a foil hood after separation of a tubular section of the film 1 and welding off at a top seam. The stack 2 of goods may be a plurality of packages stacked to form a parallelepiped on a pallet 3, or a single large object, e.g. a washing machine.

Figure 3:
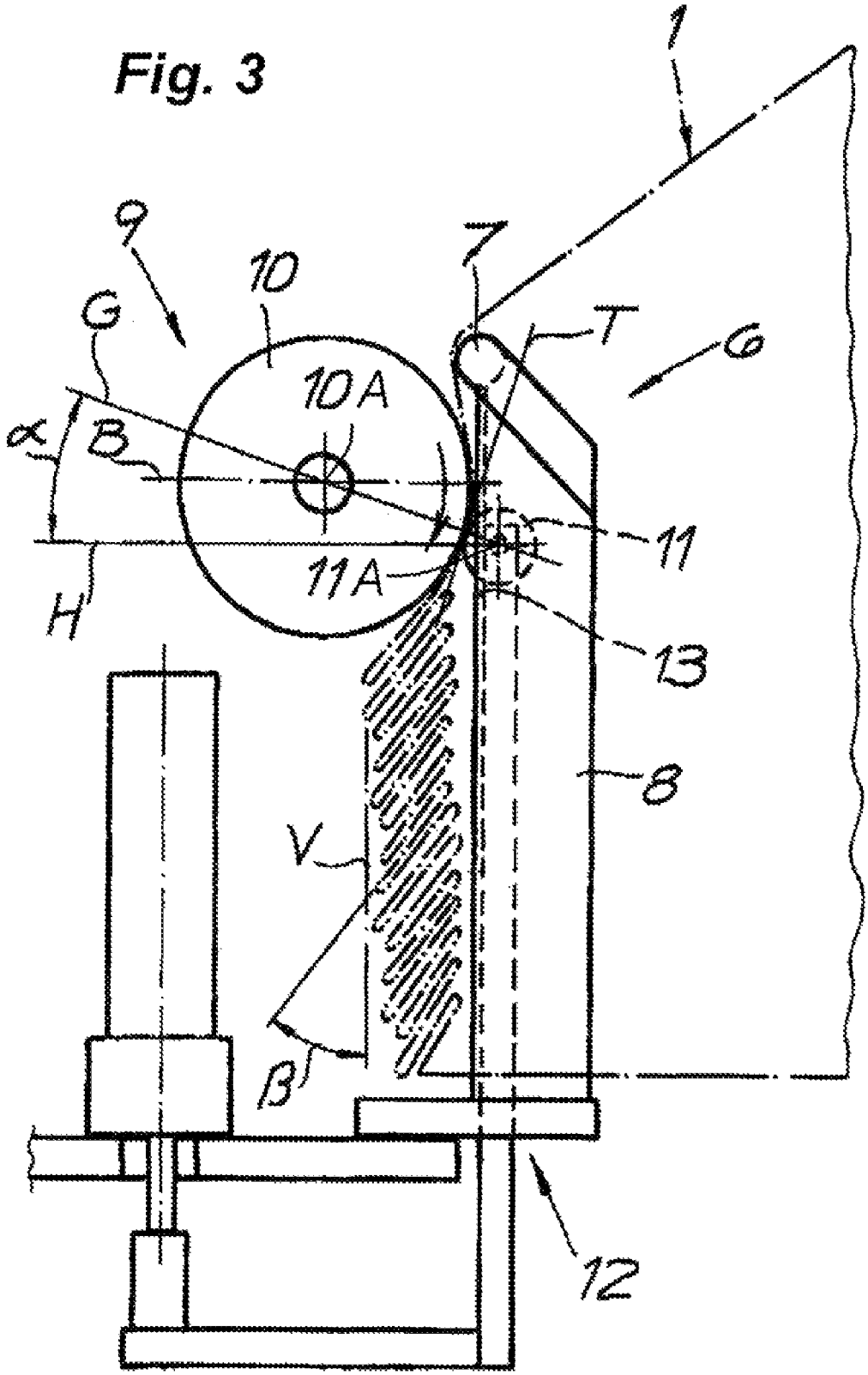
FIG. 3 is a large-scale view of a detail of FIG. 1 in the gathering position.
Figure 4:
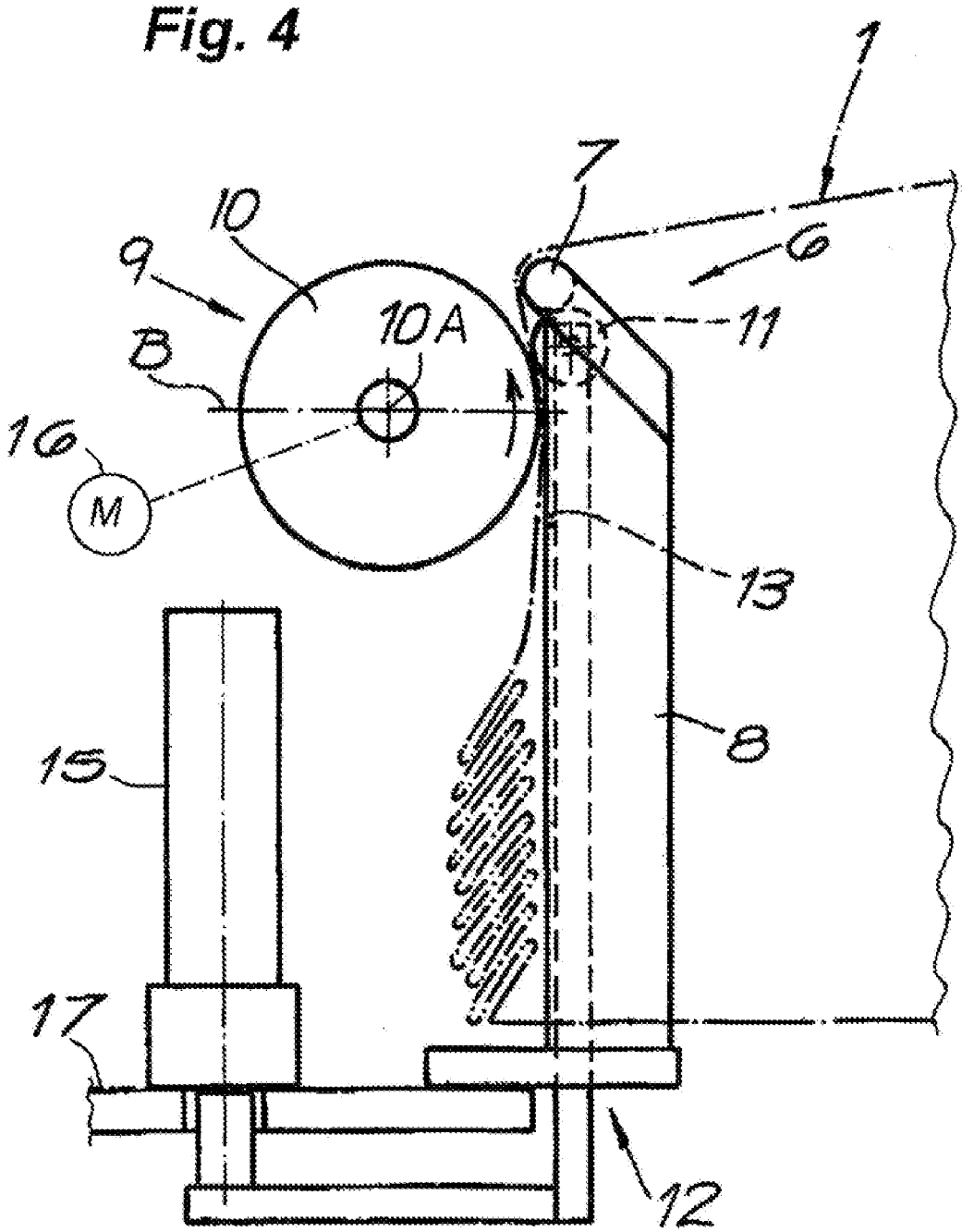
FIG. 4 is a view of the FIG. 3 detail in the ungathering position.
Figure 5:
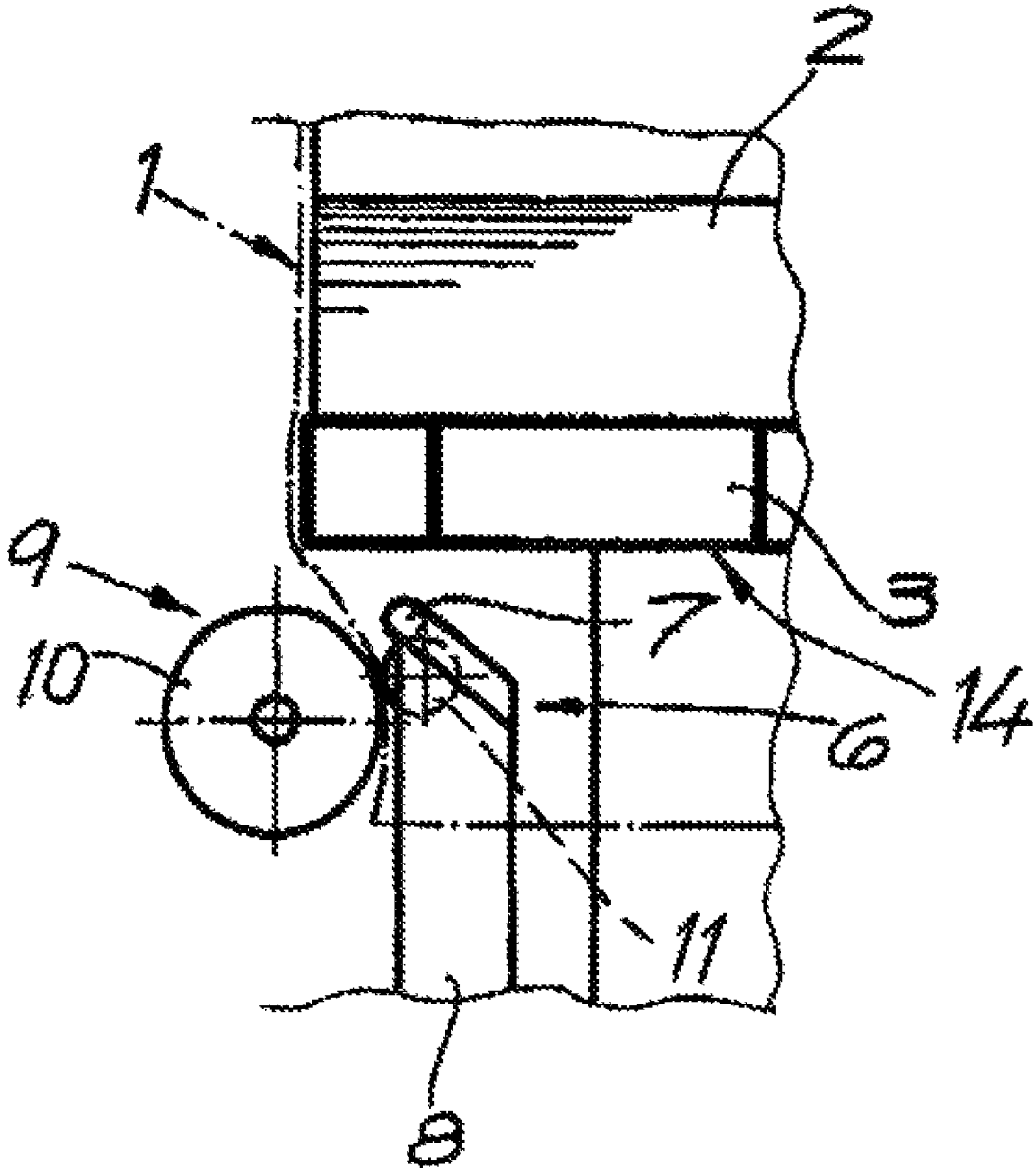
FIG. 5 shows the structure of FIG. 4 when engaged underneath the object.

The tubular film 1 is fed in a manner known per se from a supply roll 4 and is opened above the stack 2 of goods by a spreader 5. Four gatherers 6 are then fitted into the open lower end of the tubular film 1, so that the inner side of the tubular film 1 lies against these gatherers 6. Here the gatherers 6 are arranged at the four corners of an opened or spread-out tubular film 1 that is of square section once it has been spread. The gatherers 6 each have an L-shaped gathering bracket 7 extending transversely to the feeding direction Z of the tubular film 1, and a pair of vertical legs 8 supporting the gathering bracket 7 and defining at the corner just below the bracket 7 a vertically extending slot 13. Preferably the two arms of the gathering bracket 7 extend inward and downward as shown in FIGS. 3, 4 and 5. The lower ends of the legs 8 are fixed to a frame (FIG. 4) that can be moved up and down on a frame 19 of the machine by an actuator illustrated schematically at 18 and operated by a controller also illustrated schematically at 20.

The tubular film 1 is first gathered. To this end, a roller arrangement 9 comprised of a gathering roller 10 and a respective counter-roller 11 is associated with each gatherer 6, also mounted on the vertically movable frame 17 and rotatable about respective axes 10A and 11A. In FIG. 3 the roller arrangement 9 is shown in the gathering position in which the counter-roller 11 is arranged generally beneath a horizontal plane B passing through the horizontal rotation axis 10A of the respective gathering roller 10. The tubular film 1 is pulled off the tubular film supply 4, guided by the gathering brackets 7 and between the respective gathering the counter-rollers 10 and 11. The gathering rollers 10 are of larger diameter than the is respective counter-rollers 11. FIG. 3 shows the gathering rollers 10 and the counter-rollers 11 in the gathering position with the rotation axis 11A of the counter-roller 11 below the rotation axis 10A of the gathering roller 10. Hence the rotation axis 10A of the gathering roller 10 and the counter-roller 11 are relatively oriented such that in the gathering position a tangent T to the contact point of the cylindrical outer surface of the gathering roller 10 and the associated cylindrical outer surface of the counter-roller 11 extends obliquely downward and outward (FIG. 3). A straight line G running through the rotation axes 10A and 11*a* of the gathering roller 10 and the counter-roller 11 forms an angle $\alpha$ of 5° to 25°, preferably of 10° to 20° with a horizontal line or plane H running through the rotation axis 11A of the counter-roller 11. The roller axis 10A is fixed relative to the frame 17 but as described, the axis 11A can be shifted vertically, to which end each roller 11 is journaled at the upper end of a respective arm 12 vertically shiftable on the frame 17 by a respective actuator 15 also operated by the controller 20. The rollers 11 engage through the respective slot 13 with the inner face of the tube 11 and therethrough with the periphery of the respective roller 10.

After being pulled down through the roller arrangements 9 by rotation of the outer rollers via a drive illustrated schematically at 16 (FIG. 4 only), the tubular film 1 is gathered. The relative orientations of the rotation axes 10A and 11A of the rollers 10 and 11 makes it possible to create a very uniform fold formation as shown in FIG. 3. The folds of the gathered tubular film 1 point obliquely downward and outward. An angle $\beta$ between the folds and a vertical plane or line V is 20° to 60°, preferably 45° or approximately 45°. Owing to this uniform alignment of the folds, the tubular film 1 can be ungathered smoothly and free of damage as it is subsequently pulled down over the stack 2 of goods. After the gathering of the tubular film 1, the tubular film 1 is cut across above the gatherers 4 by a device that is not shown and is welded off by an unillustrated welding apparatus so that a downwardly open foil hood is formed.

Figure 1:
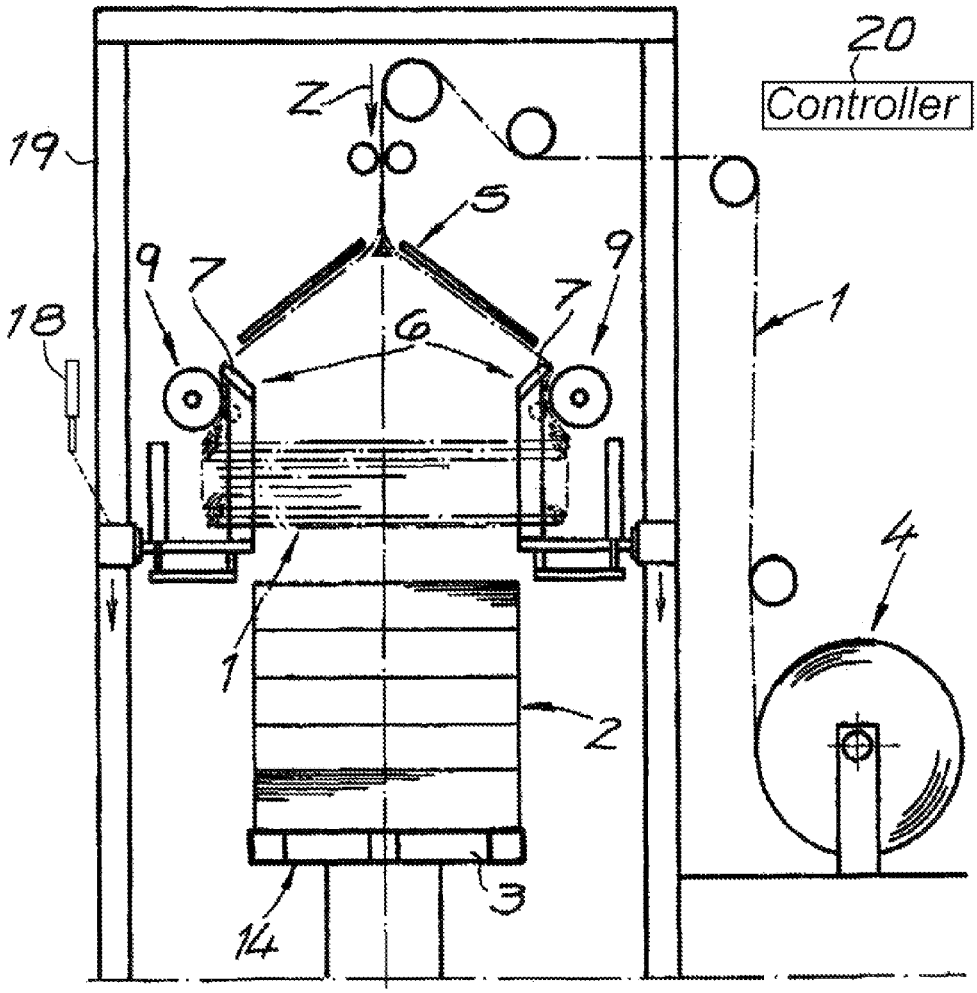
FIG. 1 is a partly schematic end view of the apparatus of this invention.
Figure 2:
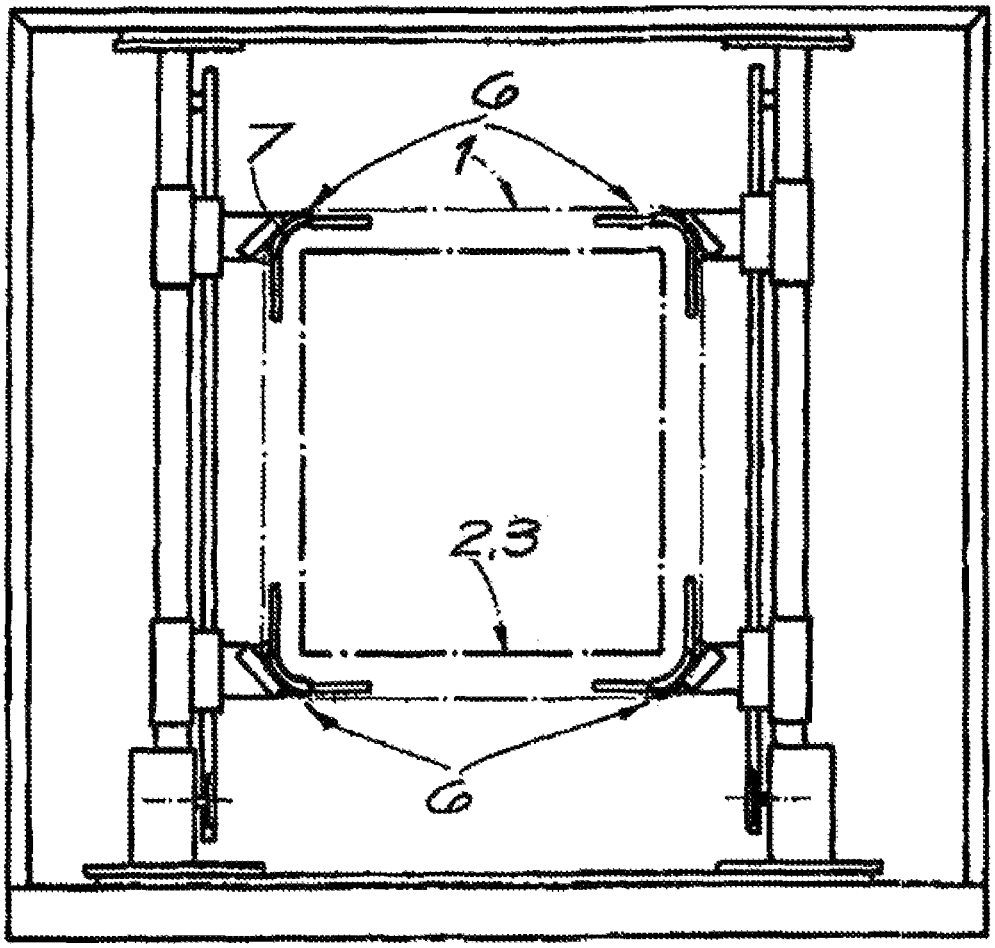
FIG. 2 is a top view of the apparatus.

It is within the scope of the invention to transversely stretch the gathered tubular film so that its horizontal cross-sectional size is greater than the horizontal cross-sectional size of the stack 2 of goods. According to a particularly preferred embodiment of the invention, the gatherers 6 or the gathering brackets 7 and their legs 8 are also used as transverse-stretching elements. Thus for transversely stretching the gathered tubular film 1 the gatherers 6 are moved apart diagonally. FIG. 2 shows the gatherers 6 after the transverse-stretching over the stack 2 of goods, the unstretched shape of the hood or tube being showed in a thick dot-dash line and the stretched shape in a thin dot-dash line.

After gathering and transverse stretching, the tubular film 1 is pulled down over the stack 2 of goods by means of the is actuator 18. According to a preferred embodiment and in the illustrated embodiment, the gatherers 6 form at the same time the guide elements for this covering process. To this end, the gatherers 6 are movable vertically downward by downward shifting of the frame 17 carrying all four gatherers 6 and the respective four roller assemblies 9. Before or immediately after the downward ungathering/pull-down stroke starts, the inner rollers 11 are shifted from their gathering position generally below the respective outer rollers 10 and shown in FIG. 3 and their ungathering position generally above the respective outer rollers 10 and shown in FIG. 4. Also, during this downward movement of the frame 17 with the gatherers 4 and roller assemblies 9, the drive 16 is reversed by the controller 20 to pull up the tube 2 pinched between the rollers 10 and 11, ensuring its smooth unfurling. Thus during the covering or during the downward movement of the gatherers 6, the gathered tubular film 1 is ungathered again, the folds of the gathered tubular film 1 being are gradually drawn off and loosened. During covering and ungathering, the tubular film 1 runs through the roller arrangements 9 in the opposite direction compared with the gathering process, and is subsequently guided via the gathering brackets 7.

At the end of the covering process or when the gatherers 6 draw close to the pallet 3, the vertical movement of the gatherers 6 is preferably slowed down. The counter-rollers 11 are in their ungathering position in which they are generally above the respective roller 10 and immediately underneath the respective gathering bracket 7. In this ungathering position the counter-roller 11 is above the roller arrangement reference plane B. The (imaginary) roller arrangement reference plane B is fixedly arranged in relation to the roller arrangements 9 or in relation to the roller arrangement apparatuses, and is moved in the covering direction with the roller arrangements 9 with the frame 17. For movement into the ungathering position, the counter-rollers 11 are preferably movable on a linear guide 12. In the illustrated embodiment, the counter-rollers 11 respectively engage through a vertical slot 13 in the associated vertical walls or legs 8. During the covering process, at the latest in the ungathering position of the counter-rollers 11, the gathering rollers 10 are moved to the counter-rollers 11 again. FIG. 4 shows this ungathering position in the case of a gathering roller 10. In the ungathering position, furthermore, preferably the rotation axes of the counter-rollers 11 are arranged vertically above the rotation axes of the gathering rollers 10. It can also be seen from FIG. 4 that the tube film end that is to be ungathered is held virtually up to the end or up to the end of the covering process between counter-rollers 11 and gathering rollers 10 and can therefore be guided in a controlled manner via the associated gathering bracket 7.

According to an embodiment and as shown in FIG. 5 at the end of the downward ungathering/pull-down stroke the gatherers 6 are moved vertically up into the region beneath the pallet 3. The gatherers 6 are then moved inward toward one another so that the tube film end slips out from between the rollers 10 and 11 and off the gathering brackets 7 and can be pressed up against a lower face 14 the pallet 3. Owing to the arrangement according to the invention of gathering rollers 10, counter-rollers 11 and gathering brackets 7 in the ungathering position, this placement of the tubular film end can take place in a functionally very reliable and precise manner.

We claim:

1. An apparatus for pulling a tubular film down over a large object, the apparatus comprising:

at least two roller assemblies flanking the object and each having an outer roller and a single inner roller rotatable about respective horizontal axes;

a guide on each roller assembly;

supply means for feeding a tubular film downward from above toward the object over the guides and between each inner roller and the respective outer roller;

inner-roller actuator means for shifting each inner roller between a gathering position generally below the respective outer roller and an ungathering position generally above the respective outer roller, each inner roller gripping the film with the respective outer roller in both of the respective positions;

roller-drive means for rotating the outer rollers;

assembly actuator means for vertically shifting the roller assemblies and guides along the object;

control means connected to the inner-roller actuator means, the roller-drive means, and the assembly actuator means for gathering the film by, positioning the assemblies in an upper position, orienting the inner rollers in the respective gathering positions generally below the outer rollers, and rotating the rollers while gripping the hood between them to pull the tube down and form it into folds beneath the roller assemblies;

pulling the film down over the object by orienting the inner rollers in the respective ungathering positions generally above the outer rollers, and then shifting the roller assemblies downward while rotating the rollers so as to pull the tube up and unfold it.

2. The apparatus defined in claim 1 wherein each guide is positioned generally above the rollers of the respective roller assembly.

3. The apparatus defined in claim 2 wherein there are four such roller assemblies and each guide is L-shaped.

4. The apparatus defined in claim 1, further comprising means for shifting the guides away from each other and thereby transversely stretching the folded tube.

5. The apparatus defined in claim 1 wherein during pulling of the film down the control means operates the roller drive means to reverse-rotate the rolls and pull the tube up.

6. The apparatus defined in claim 1, further comprising means for horizontally shifting the guides and roller assemblies and thereby pressing the tube against a bottom surface of the object.

7. An apparatus for pulling a tubular film down over a large object, the apparatus comprising:

four roller assemblies flanking the object and each having an outer roller and an inner roller rotatable about respective horizontal axes, the assemblies forming corners of a square;

an L-shaped guide on each roller assembly positioned above the respective rollers and each having a pair of arms angled downward from the respective corner;

supply means for feeding a tubular film downward from above toward the object over the guides and between each inner roller and the respective outer roller;

inner-roller actuator means for shifting each inner roller between a gathering position generally below the respective outer roller and an ungathering position generally above the respective outer roller;

roller-drive means for rotating the outer rollers;

assembly actuator means for vertically shifting the roller assemblies and guides along the object;

control means connected to the inner-roller actuator means, the roller-drive means, and the assembly actuator means for gathering the film by, positioning the assemblies in an upper position, orienting the inner rollers generally below the outer rollers, and rotating the rollers while gripping the hood between them to pull the tube down and form it into folds beneath the roller assemblies;

pulling the film down over the object by orienting the inner rollers generally above the outer rollers, and then shifting the roller assemblies downward while rotating the rollers so as to pull the tube up and unfold it.

8. An apparatus for pulling a tubular film down over a large object, the apparatus comprising:

four roller assemblies flanking the object and each having an outer roller and an inner roller rotatable about respective horizontal axes;

an L-shaped guide on each roller assembly positioned above the respective rollers and each having a pair of vertical legs;

supply means for feeding a tubular film downward from above toward the object over the guides and between each inner roller and the respective outer roller;

inner-roller actuator means for shifting each inner roller between a gathering position generally below the respective outer roller and an ungathering position generally above the respective outer roller;

roller-drive means for rotating the outer rollers;

assembly actuator means for vertically shifting the roller assemblies and guides along the object;

control means connected to the inner-roller actuator means, the roller-drive means, and the assembly actuator means for gathering the film by, positioning the assemblies in an upper position, orienting the inner rollers generally below the outer rollers, and rotating the rollers while gripping the hood between them to pull the tube down and form it into folds beneath the roller assemblies;

pulling the film down over the object by orienting the inner rollers generally above the outer rollers, and then shifting the roller assemblies downward while rotating the rollers so as to pull the tube up and unfold it.

9. The apparatus defined in claim 8 wherein each inner roller is between the legs of the respective guide.

* * * * *